US005711723A

United States Patent [19]

Hiraoka et al.

[11] Patent Number: 5,711,723

[45] Date of Patent: Jan. 27, 1998

[54] THREE-PIECE SOLID GOLF BALL

[75] Inventors: Hidenori Hiraoka, Akashi; Kazushige Sugimoto, Shirakawa; Keiji Moriyama, Shirakawa; Yoshimasa Koizumi, Shirakawa; Kuniyasu Horiuchi, Kobe, all of Japan

[73] Assignee: Sumitomo Rubber Industries, Ltd., Hyogo-Ken, Japan

[21] Appl. No.: 625,813

[22] Filed: Apr. 4, 1996

[30] Foreign Application Priority Data

Apr. 5, 1995 [JP] Japan ..... 7-106909

[51] Int. Cl.[6] ..... A63B 37/06; A63B 37/14

[52] U.S. Cl. ..... 473/374; 473/378

[58] Field of Search ..... 473/374, 378

[56] References Cited

U.S. PATENT DOCUMENTS 4,714,253 12/1987 Nakahara et al. ..... 473/374

FOREIGN PATENT DOCUMENTS 0625363 11/1994 European Pat. Off. .

2232162 4/1990 United Kingdom .

*Primary Examiner*—George J. Marlo

*Attorney, Agent, or Firm*—Birch, Stewart, Kolasch & Birch, LLP

[57] ABSTRACT

A three-piece solid golf ball which attains a long flight distance with excellent controllability which comprises a core having a two-layer structure of a center and a shell covering the center, and a cover covering the core, wherein the center has a diameter of 25 to 37 mm, a JIS-C hardness of 60 to 85 at its center point, and a JIS-C hardness difference between the center point and a surface of the center of not more than 4, the shell has a JIS-C surface hardness of 75 to 90, and the cover has a stiffness modulus of 1,200 to 3,600 kg/cm$^2$, with; the hardness being measured by a JIS-C type hardness tester.

3 Claims, 1 Drawing Sheet

THREE-PIECE SOLID GOLF BALL

FIELD OF THE INVENTION

The present invention relates to a three-piece solid golf ball comprising a core having a two-layer structure consisting of a center and a shell covering the center, and a cover covering the core.

BACKGROUND OF THE INVENTION

Golf balls which are commercially available at present can be classified roughly into a solid golf ball and a thread wound golf ball. The solid golf ball includes golf balls having a one-, two- and three-layer structure. Regarding a solid golf ball having a two- or three-layer structure, there has been intensively developed a golf ball which can readily stop at the time of landing. This is generally conducted by softening the cover and increasing the spin amount when hitting the ball with a short iron. In other words, controllability of a golf ball is considered to be important factor.

However, when the cover is softened to increases the spin amount and impart good controllability, it adversely lowers the rebound characteristics of the golf ball and decreases flight distance.

OBJECTS OF THE INVENTION

A main object of the present invention is to provide a solid golf ball which satisfies both long flight distance and controllability characteristics. In other words, the main object of the present invention is to provide a solid golf ball which attains a long flight distance when hit by a driver, and attains an effective amount of spin when hit by a short iron near the green to deadly stop (excellent controllability).

This object as well as other objects and advantages of the present invention will become apparent to those skilled in the art from the following description with reference to the accompanying drawing.

BRIEF EXPLANATION OF DRAWINGS

The present invention will become more fully understood from the detailed description given hereinbelow and the accompanying drawings which are given by way of illustration only, and thus, are not limitative of the present invention, and wherein.

SUMMARY OF THE INVENTION

Figure 1:
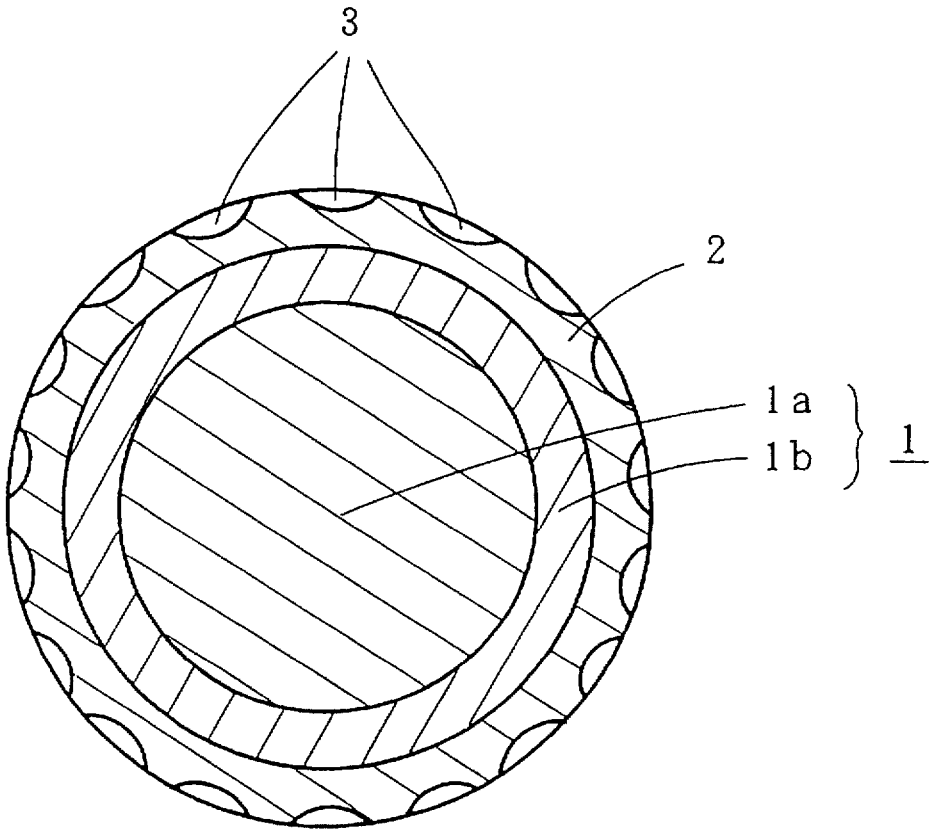
FIG. 1 is a schematic cross section illustrating one embodiment of the three-piece solid golf ball of the present invention.

The present invention provides a three-piece solid golf ball which comprises a core having a two-layer structure consisting of a center and a shell covering the center, and a cover covering the core, wherein the center has a diameter of 25 to 37 mm, a JIS-C hardness of 60 to 85 at its center point, and a JIS-C hardness difference between the center point and a surface of not more than 4, the shell has a JIS-C surface hardness of 75 to 90, and the cover is composed of a cover composition having a stiffness modulus of 1,200 to 3,600 kg/cm$^2$; the hardness being measured by a JIS-C type hardness tester.

DETAILED DESCRIPTION OF THE INVENTION

According to the present invention, rebound characteristics are enhanced and the flight distance is increased when the core is constituted with a two-layer structure comprising a center and a shell, the diameter of the center being 25 to 37 mm, the hardness of the center point of the center having a JIS-C hardness (measured by a JIS-C type hardness tester) of 60 to 85 and the JIS-C hardness difference between the center point of the center and the surface of the center being not more than 4. Also, controllability is improved by forming a cover from a cover composition having a stiffness modulus of 1,200 to 3,600 kg/cm$^2$, thereby satisfying long flight distance when hit by a driver and good controllability when hit by a short iron.

In the present invention, the center is adjusted to has a diameter of 25 to 37 mm, a JIS-C hardness of 60 to 85 at its center point, and a JIS-C hardness difference between the center point and the surface of the center of not more than 4. When the diameter of the center is smaller than 25 mm, the golf ball is hard and the shot feel is poor. On the other hand, when the diameter of the center exceeds 37 mm, the thickness of the shell is made thin, but what the shell thickness is made thin is difficult. Accordingly, the homogeneity of the characteristics of the golf ball deteriorates and the flight performance become unstable. In addition, when the hardness of the center is less than 60, the core is soft and the rebound characteristics deteriorate, which results in a shorter flight distance. On the other hand, when the hardness of the center exceeds 85, the core is too hard and brittle and, therefore, the durability deteriorates. When the hardness difference between the center point and a surface of the center exceeds 4, a large energy loss at the time of hitting is experienced and, therefore, the rebound characteristics deteriorate, which results in shorter flight distances.

In the present invention, it is necessary that the hardness of the surface of the shell (this surface of the shell corresponds to the surface of the core having a two-layer structure comprising (the center and the shell) is controlled to a hardness range of 75 to 90 and the stiffness modulus of the cover composition is 1,200 to 3,600 kg/cm$^2$. When the surface hardness of the shell is less than 75, the ball compression is small and, therefore, the rebound characteristics deteriorate, which results in a shorter flight distance. On the other hand, when the surface hardness of the shell exceeds 90, the core is too hard and, therefore, the shot feel (feeling at the time of hitting) is poor. In addition, when the stiffness modulus of the cover composition is less than 1,200 kg/cm$^2$, the rebound characteristics deteriorate, which results in a shorter flight distance. On the other hand, when the stiffness modulus of the cover composition exceeds 3,600 kg/cm$^2$, the spin amount when hit by a short iron is lowered and the controllability is poor. In the present invention, the stiffness modulus of the cover composition is used in place of the stiffness modulus of the cover. The reason is as follows. That is, once the golf ball is produced, the stiffness modulus of the cover of the golf ball is difficult to measure using a current technique and, therefore, the measurement of the stiffness modulus must be conducted after producing a sample from the cover composition. Accordingly, the stiffness modulus is not determined from the cover of the actual golf ball, but the stiffness modulus of the cover and that of a sample formed from the cover composition are considered to be substantially the same. The stiffness modulus is determined by ASTM D-747.

In the present invention, the surface hardness of the shell is defined to 75 to 90. When the surface hardness of the shell is adjusted to a hardness which is three or more higher than that of the center, all of the shot feel, rebound characteristics and flight performance are improved, and it is particularly preferred.

The center of the core is composed of a crosslinked molded article of a rubber composition. The rubber composition is generally prepared by formulating crosslinking agents, crosslinking initiators, fillers, etc. into a base rubber, and kneading the mixture. In addition, the composition may also contain antioxidants, crosslinking adjustors, softeners etc. if necessary.

The base rubbers can be butadiene rubber having a 85% or more cis-1,4 structure which may be added by other rubbers (e.g. natural rubber, isoprene rubber, styrene-butadiene rubber, etc.)if necessary.

The crosslinking agent can be metal salts of α,β-unsaturated carboxylic acid. Examples of the metal salt of α,β-unsaturated carboxylic acid are one or more metal salts of acrylic acid (e.g. zinc acrylate, magnesium acrylate, etc.) and metal salts of methacrylic acid (e.g. zinc methacrylate, magnesium methacrylate, etc.). Among them, zinc acrylate and zinc methacrylate are particularly preferred. An amount of the metal salt of α,β-unsaturated carboxylic acid as the crosslinking agent is not specifically limited, but preferably 20 to 35 parts by weight, based on 100 parts by weight of the base rubber. In addition, the metal salt of α,β-unsaturated carboxylic acid is formulated in the form of α,β-unsaturated carboxylic acid and metal oxide at the time of formulation. The metal salt of α,β-unsaturated carboxylic acid may be formed while kneading the rubber composition.

Examples of the crosslinking initiators are organic peroxides such as dicumyl peroxide, 1,1-bis(t-butylperoxy)-3,3,5-trimethylcyclohexane, 2,5-dimethyl-2,5-di(t-butylperoxy)hexane, di-t-butyl peroxide, and the like. Among them, dicumyl peroxide is particularly preferred. An amount of the crosslinking initiator is preferably 0.5 to 2.5 parts by weight, based on 100 parts by weight of the base rubber.

Examples of the fillers are inorganic fillers such as zinc oxide, barium sulfate, calcium carbonate, barium carbonate, clay, and the like. An amount of the filler is not specifically limited, but is preferably 20 to 25 parts by weight, based on 100 parts by weight of the rubber.

In case of formulating the crosslinking adjustor, sulfur compounds (e.g. morpholine disulfite, pentachlorothiophenol, diphenyl disulfite, etc.) are used as the crosslinking adjustor. It is preferred that these sulfur compounds are formulated in an amount of about 0.1 to 1.5 parts by weight, based on 100 parts by weight of the base rubber.

The center is produced by subjecting the above rubber composition for center to crosslinking molding according to press molding or injection molding. In case of press molding, the center is generally produced by crosslinking with heating at 140° to 180° C. for 10 to 60 minutes. In case of the injection molding, the center is produced by heating at a die temperature at 135° to 165° C. for 10 to 20 minutes. In addition, the diameter of the center is adjusted to 25 to 37 mm, preferably 28 to 35 mm. The heating when crosslinking molding may also be conducted in two or more stages.

The shell is also produced by subjecting the rubber composition using the same material as that of the center to crosslinking molding. In order to adjust the surface hardness of the shell to 75 to 90, an amount of the metal salt of α,β-unsaturated carboxylic acid as the crosslinking agent is preferably 25 to 35 parts by weight, based on 100 parts by weight of the base rubber. In addition, an amount of the crosslinking initiator is preferably 1 to 3 parts by weight, based on 100 parts by weight of the base rubber.

According to the same manner as that in case of the center, the crosslinking molding for producing the shell is also conducted by press molding or injection molding. In case of the press molding, a core is produced by molding a pair of semi-spherical half-shells from the rubber composition of the shell, placing a center in the half-shells, followed by crosslink molding in a mold. The crosslink molding is generally conducted at 160° to 180° C. for 10 to 40 minutes. In case of injection molding, there can be used a method comprising preparing a pair of half-shells by a simple boarding, placing a center in the half-shells, followed by press molding to prepare the core. The method comprises producing a pair of semi-vulcanized half-shells in advance by injection molding, placing a center in the half-shells, followed by press molding to prepare a core. In addition, the heating may also be conducted in two or more stages in the crosslink molding of the shell.

A thickness of the shell varies depending on the diameter of the center, but is preferably 1 to 7 mm.

As the cover, various materials can be used. For example, there can be used a cover composition prepared by adding pigments (e.g. titanium dioxide, barium sulfate, etc.) and optionally adding antioxidants to an ionomer resin or a synthetic resin, prepared by adding a polyamide, a polyester, a polyurethane, polyethylene, etc. to the ionomer resin, as the main material.

Examples of the ionomer resins are Hi-milan 1605 (Na), Hi-milan 1706 (Zn), Hi-milan 1707 (Na), Hi-milan AM7315 (Zn), Hi-milan AM7316 (Zn), Hi-milan AM7317 (Zn), Hi-milan AM7318 (Na), Hi-milan MK7320 (K), Hi-milan 1555 (Na) and Hi-milan 1557 (Zn) (trade name, manufactured by Mitsui Du Pont Polychemical Co., Ltd.); Surlyn 8920 (Na), Surlyn 8940 (Na), Surlyn AD8512 (Na), Surlyn 7930 (Li), Surlyn 7940 (Li), Surlyn 9910 (Zn), Surlyn AD8511 (Zn) and Surlyn 9650 (Zn) (trade name, manufactured by Du Pont Co., U.S.A.); and Iotek 7010 (Zn) and Iotek 8000 (Na) (trade name, manufactured by Exxon Chemical Co.). Na, Zn, K, Li, etc., which were described in parenthesis following the trade name of the above ionomer resin, mean neutralizing metal ion species thereof.

In the present invention, the stiffness modulus of the cover composition is also an important characteristic for improving the controllability, and the stiffness modulus of the cover composition is adjusted to 1,200 to 3,600 kg/cm$^2$, as described above. The stiffness modulus of the cover composition can be adjusted as described above by a selection from the above ionomer resins or a combination thereof.

The molding of the cover is conducted by a method comprising molding the above cover composition into a semi-spherical half-shell in advance, covering the core with two half-shells, followed by pressure molding at 130° to 170° C. for 1 to 15 minutes, or a method comprising injection molding the cover composition directly around the core to cover the core.

The thickness of the cover is generally about 1 to 4 mm. At the time of the cover molding, dimples are optionally formed on the surface of the golf ball. After the cover is molded, painting, stamping, etc. may be optionally provided.

Next, the three-piece solid golf ball of the present invention will be explained with reference to the drawing. FIG. 1 is a schematic cross section illustrating one embodiment of the three-piece solid golf ball of the present invention. In FIG. 1, 1 is a core and the core 1 is composed of an center 1*a* and an shell 1*b* formed around the center, and 2 is a cover for covering the above core 1.

The center 1*a* is composed of an crosslinked molded article of the rubber composition. The diameter of the center is 25 to 37 mm, the JIS-C hardness of the center of the center is within the range of 60 to 85 and the JIS-C hardness difference between the center point and a surface of the center is not more than 4. The shell 1*b* is composed of a crosslinked molded article of the rubber composition formed around the center 1*a*, and the surface hardness is within the range of 75 to 90. In addition, the cover is made of the cover composition having a stiffness modulus of 1,200 to 3,600 kg/cm$^2$ and preferably has a Shore D hardness of 59 to 70. When the cover composition has a Shore D hardness of less than 59, the golf ball has poor rebound characteristics and shorter flight distance. When it is more than 70, the ball has poor shot feel and poor controllability. The core 1 having a two-layer structure of the center 1*a* and shell 1*b* is covered with the cover.

The number 3 indicates dimples and suitable number/embodiment of dimples 3 may be optionally provided on the cover 2 so as to obtain the desired characteristics. In addition, painting, marking, etc. may be optionally provided on the surface of this three-piece solid golf ball.

As described above, according to the present invention, there could be provided a three-piece solid golf ball which attains long flight distance and is superior controllability.

EXAMPLES

The following Examples and Comparative Examples further illustrate the present invention in detail but are not to be construed to limit the scope thereof.

Examples 1 to 6 and Comparative Examples 1 to 6

According to the formulation shown in Tables 1 to 3, a rubber composition for center was prepared, respectively. The resulting rubber composition for center was charged in a mold for center and subjected to crosslinking molding under the condition shown in Tables 1 to 3 to produce an center. The diameter and hardness of the resulting center were measured. The results are shown in Tables 1 to 3. Further, the unit of the amount of the respective components to be formulated is "parts by weight," and the same may be said of the tables showing the formulation described hereinafter. The hardness of the center was measured at the center of the center, position which is 5 mm away from the center to surface, position which is 10 mm away from the center to surface, position which is 15 mm away from the center to surface, and surface, using a JIS-C type hardness tester. Further, the hardness of the interior of the center such as that of the center of the center was determined by cutting the center into halves, followed by measuring at the predetermined position, respectively.

The center formulation, diameter of the center, crosslinking condition and hardness of the center of Examples 1 to 6 are shown in Table 1. Those of comparative, Examples 1 to 3 are shown in Table 2, and those of Comparative Examples 4 to 6 are shown in Table 3. Further, the butadiene rubber used for preparing the rubber composition for center is BR-11 (trade name) manufactured by Japan Synthetic Rubber Co., Ltd., and the cis-1,4 structure content of this butadiene rubber is 96%. The antioxidant used is Noclak NS-6 (trade name) manufactured by Ohuchi Shinko Kagaku Kogyo Co., Ltd. Those in which the crosslinking condition is described in two stages indicate that the heating for crosslinking molding is conducted in two stages. Regarding those having no measuring point of the hardness at the predetermined position because of small diameter of the center, the hardness is not shown as a matter of course.

TABLE 1

| | Example No. | | | | | |
|---|---|---|---|---|---|---|
| | 1 | 2 | 3 | 4 | 5 | 6 |
| Formulation of center | | | | | | |
| Butadiene rubber | 100 | 100 | 100 | 100 | 100 | 100 |
| Zinc acrylate | 27 | 30 | 27 | 27 | 27 | 27 |
| Zinc oxide | 18.9 | 17.8 | 18.9 | 18.9 | 18.9 | 18.9 |
| Antioxidant | 0.5 | 0.5 | 0.5 | 0.5 | 0.5 | 0.5 |
| Dicumyl peroxide | 1.2 | 1.2 | 1.2 | 1.2 | 1.2 | 1.2 |
| Diameter of center (mm) | 35 | 35 | 35 | 27 | 30 | 32 |
| Crosslinking condition (°C. × minutes) | 140 × 30<br>165 × 25 | 140 × 30<br>165 × 25 | 140 × 30<br>165 × 25 | 140 × 30<br>165 × 25 | 140 × 30<br>165 × 25 | 140 × 30<br>165 × 25 |
| Hardness of center | | | | | | |
| Center point | 76 | 80 | 75 | 75 | 74 | 75 |
| Position which is 5 mm away from the center point | 76 | 80 | 74 | 74 | 73 | 74 |
| Position which is 10 mm away from the center point | 74 | 79 | 74 | 73 | 74 | 75 |
| Position which is 15 mm away from the center point | 76 | 80 | 73 | — | — | 74 |
| Surface | 77 | 79 | 73 | 75 | 74 | 75 |

TABLE 2

| | Comparative Example No. | | |
|---|---|---|---|
| | 1 | 2 | 3 |
| Formulation of center: | | | |
| Butadiene rubber | 100 | 100 | 100 |
| Zinc acrylate | 25 | 23 | 30 |
| Zinc oxide | 19.6 | 20.4 | 17.8 |
| Antioxidant | 0.5 | 0.5 | 0.5 |
| Dicumyl peroxide | 1.5 | 1.5 | 1.2 |
| Diameter of center: (mm) | 35 | 35 | 20 |
| Crosslinking condition (°C. × minutes) | 165 × 25 | 150 × 25 | 140 × 33<br>165 × 25 |
| Hardness of center | | | |
| Center point | 58 | 55 | 82 |
| Position which is 5 mm away from the center point | 61 | 55 | 81 |
| Position which is 10 mm away from the center point | 63 | 56 | — |
| Position which is 15 mm away from the center point | 68 | 58 | — |
| Surface | 75 | 59 | 80 |

TABLE 3

| | Comparative Example No. | | |
|---|---|---|---|
| | 4 | 5 | 6 |
| Formulation of center: | | | |
| Butadiene rubber | 100 | 100 | 100 |
| Zinc acrylate | 30 | 27 | 27 |
| Zinc oxide | 17.8 | 18.9 | 18.9 |
| Antioxidant | 0.5 | 0.5 | 0.5 |

TABLE 3-continued

| | Comparative Example No. | | |
|---|---|---|---|
| | 4 | 5 | 6 |
| Dicumyl peroxide | 1.2 | 1.2 | 1.2 |
| Diameter of center (mm) | 38 | 27 | 27 |
| Crosslinking condition (°C. × minutes) | 140 × 30<br>165 × 25 | 140 × 30<br>165 × 25 | 140 × 30<br>160 × 25 |
| Hardness of center | | | |
| Center point | 79 | 75 | 75 |
| Position which is 5 mm away from the center point | 80 | 74 | 74 |
| Position which is 10 mm away from the center point | 81 | 73 | 73 |
| Position which is 15 mm away from the center point | 80 | — | — |
| Surface | 81 | 75 | 75 |

Next, a rubber composition for shell was prepared according to the formulation shown in Tables 4 to 6 and a pair of semi-vulcanized half-shells were molded from the rubber composition for shell. Then, the composition was covered on the above center and subjected to crosslinking molding in a die under the crosslinking condition shown in Tables 4 to 6 to produce a core having a diameter of 39 mm. The surface hardness of the resulting core (i.e. surface hardness of the shell) was measured by a JIS-C type hardness tester. The results are shown in Tables 4 to 6. Regarding Comparative Example 4, the diameter of the center is too large and, therefore, the thickness of the shell is thin and scatter in thickness is too large, thereby making it impossible to conduct a proper evaluation of characteristics. Accordingly, the surface hardness of the core was not measured and, therefore, the measuring results of the surface hardness of the core of Comparative Example 4 are not shown in Table 6. In addition, the butadiene rubber and antioxidant, which were used for preparing the rubber composition for shell, are the same as those used for preparing the center.

TABLE 4

| | Example No. | | | | | |
|---|---|---|---|---|---|---|
| | 1 | 2 | 3 | 4 | 5 | 6 |
| Formulation of shell | | | | | | |
| Butadiene rubber | 100 | 100 | 100 | 100 | 100 | 100 |
| Zinc acrylate | 31 | 31 | 25 | 31 | 31 | 30 |
| Zinc oxide | 17.5 | 17.5 | 19.7 | 17.5 | 17.5 | 17.5 |
| Antioxidant | 0.5 | 0.5 | 0.5 | 0.5 | 0.5 | 0.5 |
| Dicumyl peroxide | 2.0 | 2.0 | 2.0 | 2.0 | 2.0 | 2.0 |
| Crosslinking condition (°C. × minutes) | 165 × 15 | 165 × 15 | 165 × 15 | 165 × 20 | 165 × 15 | 165 × 15 |
| Surface hardness of core | 84 | 84 | 78 | 87 | 83 | 82 |

TABLE 5

| | Comparative Example No. | | |
|---|---|---|---|
| | 1 | 2 | 3 |
| Formulation of shell | | | |
| Butadiene rubber | 100 | 100 | 100 |
| Zinc acrylate | 31 | 20 | 31 |
| Zinc oxide | 17.5 | 21.5 | 17.5 |
| Antioxidant | 0.5 | 0.5 | 0.5 |
| Dicumyl peroxide | 2.0 | 1.2 | 3.0 |
| Crosslinking condition (°C. × minutes) | 165 × 20 | 165 × 20 | 165 × 15 |
| Surface hardness of core | 84 | 63 | 84 |

TABLE 6

| | Comparative Example No. | | |
|---|---|---|---|
| | 4 | 5 | 6 |
| Formulation of shell | | | |
| Butadiene rubber | 100 | 100 | 100 |
| Zinc acrylate | 31 | 31 | 31 |
| Zinc oxide | 17.5 | 17.5 | 17.5 |
| Antioxidant | 0.5 | 0.5 | 0.5 |
| Dicumyl peroxide | 2.0 | 2.0 | 2.0 |
| Crosslinking condition (°C. × minutes) | 165 × 15 | 165 × 20 | 165 × 20 |
| Surface hardness of core | — | 87 | 87 |

Then, cover compositions A to G were prepared according to the formulation shown in Table 7, and the stiffness modulus of the resulting cover compositions was measured, respectively. The results are shown in Table 7. Further, the stiffness modulus of the cover composition was measured as follows. That is, the cover composition was subjected to press molding to produce a sheet sample having an thickness of about 2 mm and, after standing at 23° C. (relative humidity: 50%) for two weeks, the stiffness modulus was measured according to ASTM D-747, using a stiffness modulus tester manufactured by Toyo Seiki Co., Ltd.

TABLE 7

| | A | B | C | D | E | F | G |
|---|---|---|---|---|---|---|---|
| Hi-milan 1855*1 | 75 | 40 | 31 | 90 | 10 | 0 | 0 |
| Hi-milan 1555*2 | 5 | 0 | 10 | 0 | 45 | 6 | 0 |
| Hi-milan 1706*3 | 20 | 30 | 0 | 10 | 45 | 45 | 50 |
| Hi-milan 1557*4 | 0 | 30 | 59 | 0 | 0 | 6 | 0 |
| Hi-milan 1605*5 | 0 | 0 | 0 | 0 | 0 | 44 | 50 |
| Titanium dioxide | 1.0 | 1.0 | 1.0 | 1.0 | 1.0 | 1.0 | 1.0 |
| Stiffness modulus ($kg/cm^2$) | 1500 | 2000 | 2500 | 1000 | 3000 | 3500 | 3700 |
| Cover hardness (Shore D) | 60 | 62 | 64 | 57 | 67 | 69 | 72 |

*1: Hi-milan 1855 (trade name): ethylene-butyl acrylate-methacrylic acid three-dimensional copolymer ionomer resin obtained by neutralizing with a zinc ion, manufactured by Mitsui Du Pont Polychemical Co., stiffness modulus: about 900 $kg/cm^2$

*2: Hi-milan 1555 (trade name): ethylene-methacrylic acid copolymer ionomer resin obtained by neutralizing with a sodium ion, manufactured by Mitsui Du Pont Polychemical Co., stiffness modulus: about 2,100 $kg/cm^2$

*3: Hi-milan 1706 (trade name): ethylene-methacrylic acid copolymer ionomer resin obtained by neutralizing with a zinc ion, manufactured by Mitsui Du Pont Polychemical Co., stiffness modulus: about 2,500 $kg/cm^2$ TABLE 7-continued

| | A | B | C | D | E | F | G |
|---|---|---|---|---|---|---|---|

*4: Hi-milan 1557 (trade name): ethylene-methacrylic acid copolymer ionomer resin obtained by neutralizing with a zinc ion, manufactured by Mitsui Du Pont Polychemical Co., stiffness modulus: about 2,400 kg/cm²
*5: Hi-milan 1605 (trade name): ethylene-methacrylic acid copolymer ionomer resin obtained by neutralizing with a sodium ion, manufactured by Mitsui Du Pont Polychemical Co., stiffness modulus: about 3,500 kg/cm²

Then, the cover composition thus prepared as described above was injection molded on the above core according to the combination shown in Tables 8 to 10 to form a cover, thereby producing a three-piece solid golf ball having an outer diameter of 42.7 min. In Tables 8 to 10, the stiffness modulus of the cover composition was shown together with the symbol of the cover composition. Regarding Comparative Example 4, it is impossible to conduct a proper evaluation of characteristics because the difference in thickness is too large when the shell is formed. Therefore, the golf ball was not produced. Accordingly, the stiffness modulus of the cover composition and characteristic values with respect to Comparative Example 4 are not shown in Table 10.

The ball weight, the ball compression due to US PGA system, rebound coefficient, flight distance (carry), spin amount, controllability and shot feel of the resulting golf ball were examined. The results are shown in Tables 8 to 10. Further, the measuring method or evaluation method of the above rebound coefficient, flight distance (carry), spin amount, controllability and shot feel is as follows.

Rebound coefficient:

A metal cylinder (198.4 g) was struck against a golf ball at a speed of 45 m/second using the same initial velocity measuring air gun as one used in R&A (British Golf Society) to measure a ball speed, and then the rebound coefficient was calculated from the ball speed. The larger this value, the higher the rebound characteristics of the golf ball become.

Flight distance:

A driver (No. 1 wood club) was mounted to a Swing robot manufactured by True Temper Co., and then a golf ball was hit at a head speed of 45 m/second to measure a distance to the dropping point as the flight distance.

Spin amount:

A No. 9 iron club was mounted to a Swing robot manufactured by True Temper Co., and then a golf ball was hit with a head speed of 34 m/second. The photograph of the hit golf ball was continuously taken to determine the spin amount.

Controllability:

It is evaluated by practically hitting a golf ball with a sand wedge due to 10 golfers of four professional golfers and six amateur golfers having a handicap of not more than 10. The evaluation criteria are as follows. The results shown in the Tables below are based on the fact that not less than 8 out of 10 professional golfers evaluated with the same criterion.

Evaluation criteria

○: Good

Δ: Ordinary x: Poor

Shot feel:

It is evaluated by practically hitting a golf ball with a driver (No. 1 wood club) due to 10 golfers of four professional golfers and six amateur golfers having a handicap of not more than 10. The evaluation criteria are as follows. The results shown in the Tables below are based on the fact that not less than 8 out of 10 professional golfers evaluated with the same criterion.

Evaluation criteria

○: Good

Δ: Ordinary x: Poor

TABLE 8

| | Example No. | | | | | |
|---|---|---|---|---|---|---|
| | 1 | 2 | 3 | 4 | 5 | 6 |
| Stiffness modulus of cover composition (kg/cm²) | 1500 A | 2000 B | 2500 C | 1500 A | 3000 E | 3500 F |
| Ball weight (g) | 45.24 | 45.41 | 45.35 | 45.23 | 45.28 | 45.31 |
| Ball compression (USGA) | 90 | 100 | 95 | 97 | 102 | 104 |
| Rebound coefficient | 0.7524 | 0.7612 | 0.7600 | 0.7589 | 0.7626 | 0.7635 |
| Flight distance (yard) | 223 | 226 | 224 | 223 | 223 | 226 |
| Spin amount (rpm) | 7410 | 7200 | 7010 | 7370 | 7010 | 6950 |
| Controllability | ○ | ○ | ○ | ○ | ○ | ○ |
| Shot feel | ○ | ○ | ○ | ○ | ○ | ○ |
| Overall evaluation | ○ | ○ | ○ | ○ | ○ | ○ |

TABLE 9

| | Comparative Example No. | | |
|---|---|---|---|
| | 1 | 2 | 3 |
| Stiffness modulus of cover composition (kg/cm²) | 2000 B | 2000 B | 2000 B |
| Ball weight (g) | 45.32 | 45.31 | 45.33 |
| Ball compression (USGA) | 87 | 50 | 111 |
| Rebound coefficient | 0.7400 | 0.7324 | 0.7630 |
| Flight distance (yard) | 214 | 210 | 222 |
| Spin amount (rpm) | 7000 | 6540 | 7000 |
| Controllability | Δ | X | X |
| Shot feel | Δ | X | X |
| Overall evaluation | X | X | X |

TABLE 10

| | Comparative Example No. | | |
|---|---|---|---|
| | 4 | 5 | 6 |
| Stiffness modulus of cover composition (kg/cm²) | A golf ball was not produced. | 1000 D | 3700 G |
| Ball weight (g) | — | 45.25 | 45.23 |
| Ball compression (USGA) | — | 90 | 109 |
| Rebound coefficient | — | 0.7365 | 0.7645 |
| Flight distance (yard) | — | 212 | 226 |
| Spin amount (rpm) | — | 7730 | 6400 |
| Controllability | — | Δ | X |
| Shot feel | — | Δ | X |
| Overall evaluation | — | X | X |

As is apparent from a comparison between ball characteristics of Examples 1 to 6 shown in Table 8 and those of Comparative Examples 1 to 3 and Comparative Example 5 to 6 shown in Tables 9 to 10, the golf balls of Examples 1 to 6 attained large flight distance and large spin amount and were superior in controllability and shot feel.

To the contrary, regarding the golf ball of Comparative Example 1, the hardness of the center of the center is low and hardness difference between the center and surface of the center is large and, therefore, the rebound characteristics deteriorate which decrease the flight distance. In addition, the controllability and shot feel were not good. Regarding the golf ball of Comparative Example 2, the hardness of the center of the center and that of the surface of the shell are too low and, therefore, the rebound characteristics deteriorate which decrease the flight distance. In addition, the shot feel was also heavy and poor. Regarding the golf ball of Comparative Example 3, the diameter of the center is small and, therefore, the golf ball is hard, which results in poor shot feel and controllability.

Regarding the golf ball of Comparative Example 5, the stiffness modulus of the cover is small and, therefore, the rebound characteristics were deteriorated to decrease the flight distance. Regarding the golf ball of Comparative Example 6, the stiffness modulus of the cover is too large and, therefore, both controllability and shot feel were poor. Regarding the golf ball of Comparative Example 4, the diameter of the center is too large as described above and, therefore, variation in thickness of the shell is too large when the shell was formed to produce a core, thereby making it impossible to conduct a proper evaluation of characteristics. Therefore, a golf ball was not produced.

What is claimed is:

1. A three-piece solid golf ball comprising a core having a two-layer structure of a center and a shell covering the center, and a cover covering the core, wherein the center has a diameter of 25 to 37 mm, a JIS-C hardness of 60 to 85 at its center point, and a JIS-C hardness difference between the center point and a surface of the center of not more than 4, the shell has a JIS-C surface hardness of 75 to 90, and the cover has a stiffness modulus of 1,200 to 3,600 kg/cm$^2$ with the hardness being measured by a JIS-C type hardness tester.

2. The three-piece solid golf ball according to claim 1, wherein the JIS-C surface hardness of the shell is higher than that of the center.

3. The three-piece solid golf ball according to claim 1, wherein the cover has a Shore D hardness of 59 to 70.

* * * * *